US011248395B2

(12) United States Patent
Stein et al.

(10) Patent No.: US 11,248,395 B2
(45) Date of Patent: Feb. 15, 2022

(54) ELECTROMECHANICAL LOCKING LATCH

(71) Applicant: Southco, Inc., Concordville, PA (US)

(72) Inventors: Ingo Stein, Concordville, PA (US); Jonathan Rebbeck, Concordville, PA (US); Nicholas Bennett, Concordville, PA (US)

(73) Assignee: Southco, Inc., Concordville, PA (US)

( * ) Notice: Subject to any disclaimer, the term of this patent is extended or adjusted under 35 U.S.C. 154(b) by 542 days.

(21) Appl. No.: 15/998,608

(22) PCT Filed: Feb. 15, 2017

(86) PCT No.: PCT/US2017/017910

§ 371 (c)(1),
(2) Date: Aug. 16, 2018

(87) PCT Pub. No.: WO2017/142908

PCT Pub. Date: Aug. 24, 2017

(65) Prior Publication Data

US 2020/0270903 A1 Aug. 27, 2020

Related U.S. Application Data

(60) Provisional application No. 62/295,719, filed on Feb. 16, 2016.

(51) Int. Cl.
*E05B 47/00* (2006.01)
*E05B 17/00* (2006.01)
(Continued)

(52) U.S. Cl.
CPC ..... *E05B 47/0012* (2013.01); *E05B 17/0037* (2013.01); *E05B 47/026* (2013.01);
(Continued)

(58) Field of Classification Search
CPC ..... E05B 47/0012; E05B 17/0037; E05B 47/026; E05B 55/00; E05B 2047/0017;
(Continued)

(56) References Cited

U.S. PATENT DOCUMENTS 2,936,892 A * 5/1960 Mcneil ..... E05B 47/0607 210/146
4,074,545 A * 2/1978 Case ..... D06F 37/42 68/12.26
(Continued)

FOREIGN PATENT DOCUMENTS

CN 2680799 Y 2/2005
CN 103590667 A 2/2014
(Continued)

OTHER PUBLICATIONS

International Preliminary Report on Patentability for Application No. PCT/US2017/017910, dated Aug. 21, 2018—11 pages.
(Continued)

*Primary Examiner* — Kristina R Fulton
*Assistant Examiner* — Emily G. Brown
(74) *Attorney, Agent, or Firm* — RatnerPrestia

(57) ABSTRACT

An electronic latch assembly includes a latch bolt movable between an extended position and a retracted position; and a motor having a rotatable output shaft arrangement that is either directly or indirectly connected to the latch bolt for moving the latch bolt between the extended and retracted positions and rotating the output shaft arrangement between a first angular position in which the latch bolt is capable of being translated to the retracted position and a second angular position in which the latch bolt is locked and not capable of being translated to the retracted position.

4 Claims, 18 Drawing Sheets

(51) Int. Cl.
*E05B 47/02* (2006.01)
*E05B 55/00* (2006.01)
*E05B 47/06* (2006.01)

(52) U.S. Cl.
CPC ..... *E05B 47/0607* (2013.01); *E05B 55/00* (2013.01); *E05B 2047/0017* (2013.01); *E05B 2047/0024* (2013.01); *E05B 2047/0069* (2013.01); *E05B 2047/0094* (2013.01)

(58) Field of Classification Search
CPC ..... E05B 2047/0024; E05B 2047/0069; E05B 2047/0094; E05B 2047/0015; E05B 2047/0016; E05B 2047/0036; E05B 2047/0081; Y10T 292/1021; Y10T 292/1016; Y10T 292/0976
See application file for complete search history.

(56) References Cited

U.S. PATENT DOCUMENTS 5,473,922 A * 12/1995 Bair ..... E05B 47/0012 292/144
6,038,896 A * 3/2000 Chamberlain ..... E05B 47/0012 70/277
6,112,563 A * 9/2000 Ramos ..... G07C 9/00182 70/278.1
6,619,085 B1 * 9/2003 Hsieh ..... E05B 47/0012 292/144
7,455,335 B2 * 11/2008 Garneau ..... E05B 47/0012 292/144
8,403,376 B2 * 3/2013 Greiner ..... D06F 37/42 68/12.26
8,496,275 B2 7/2013 Garneau et al.

FOREIGN PATENT DOCUMENTS

DE 4407912 A1 8/1995
DE 102011055421 5/2013
EP 2594711 A2 5/2013
JP 2502680 Y 6/1996

OTHER PUBLICATIONS

International Search Report and Written Opinion for International Application No. PCT/US2017/017910, dated Jul. 10, 2017—14 pages.
Japanese Notice of Reasons for Rejection for Japanese Application No. 2018-561200, dated Mar. 23, 2021 with translation, 3 pages.
Chinese Office Action for Chinese Application No. 2017800118325, dated Mar. 9, 2020 with translation, 12 pages.

* cited by examiner

OUTPUT CAM POSITION FOR LOCKING OF LATCH BOLT

UN-LOCKED

OUTPUT CAM IN THE UN-LOCKED POSITION

OUTPUT CAM

LOCKED

OUTPUT CAM IN THE LOCKED POSITION

OUTPUT CAM IN THE LOCKED POSITION SHOWING THE LOCKING SURFACE IN THE LATCH BOLT (VIEWED IN OPPOSITE DIRECTION)

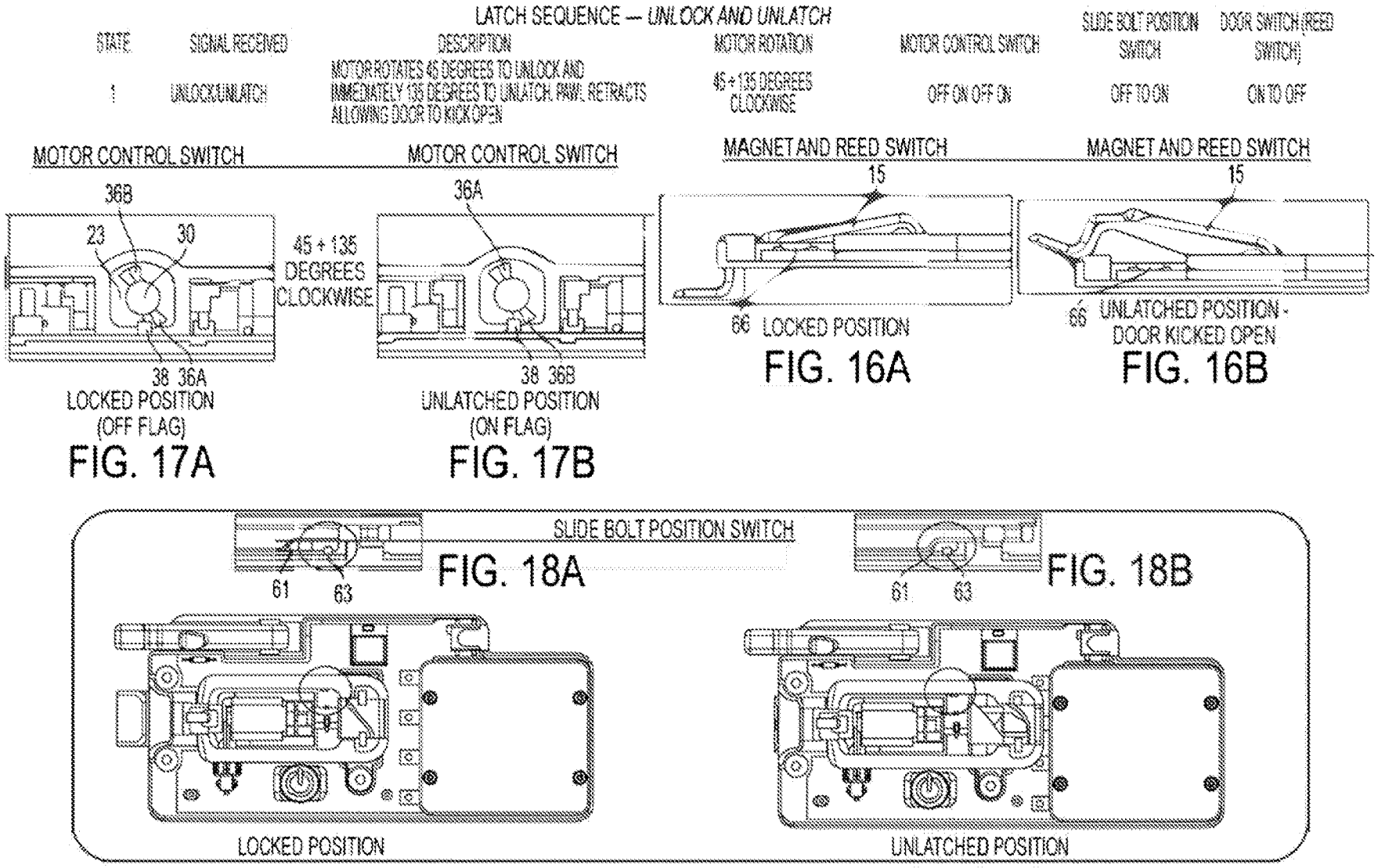
LATCH SEQUENCE — UNLOCK AND UNLATCH
STATE
SIGNAL RECEIVED
DESCRIPTION
MOTOR ROTATION
MOTOR CONTROL SWITCH
SLIDE BOLT POSITION SWITCH
DOOR SWITCH (REED SWITCH)
1
UNLOCK/UNLATCH
MOTOR ROTATES 45 DEGREES TO UNLOCK AND IMMEDIATELY 135 DEGREES TO UNLATCH. PANEL RETRACTS ALLOWING DOOR TO KICK OPEN
45 + 135 DEGREES CLOCKWISE
OFF ON OFF ON
OFF TO ON
ON TO OFF
MOTOR CONTROL SWITCH
MAGNET AND REED SWITCH
15
23
30
36B
36A
38
LOCKED POSITION (OFF FLAG)
FIG. 17A
UNLATCHED POSITION (ON FLAG)
FIG. 17B
LOCKED POSITION
FIG. 16A
UNLATCHED POSITION - DOOR KICKED OPEN
FIG. 16B
SLIDE BOLT POSITION SWITCH
61
63
FIG. 18A
FIG. 18B
LOCKED POSITION
UNLATCHED POSITION LATCH SEQUENCE- *RESET LATCHED*
| STATE | SIGNAL RECEIVED | DESCRIPTION | MOTOR ROTATION | MOTOR CONTROL SWITCH | SLIDE BOLT POSITION SWITCH | DOOR SWITCH (REED SWITCH) |
|---|---|---|---|---|---|---|
| 2 | NONE | PAWL EXTENDS UNDER SPRING FORCE (TIMED) | 45 DEGREES CLOCKWISE | ON TO OFF | ON TO OFF | OFF |
| | PAWL EXTEND | PAWL EXTENDS UNDER SPRING FORCE (SIGNAL) | | | | |
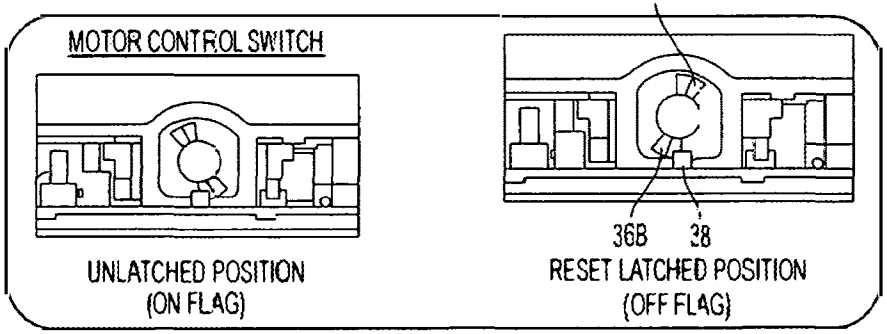
FIG. 17E
FIG. 17C
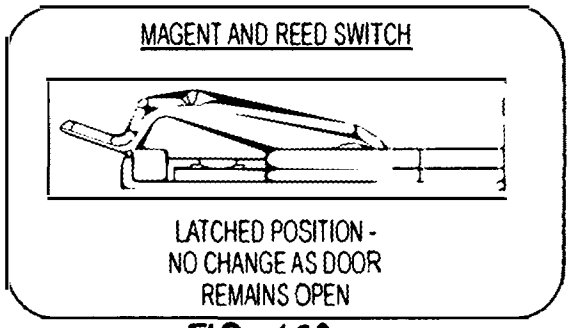
FIG. 16C
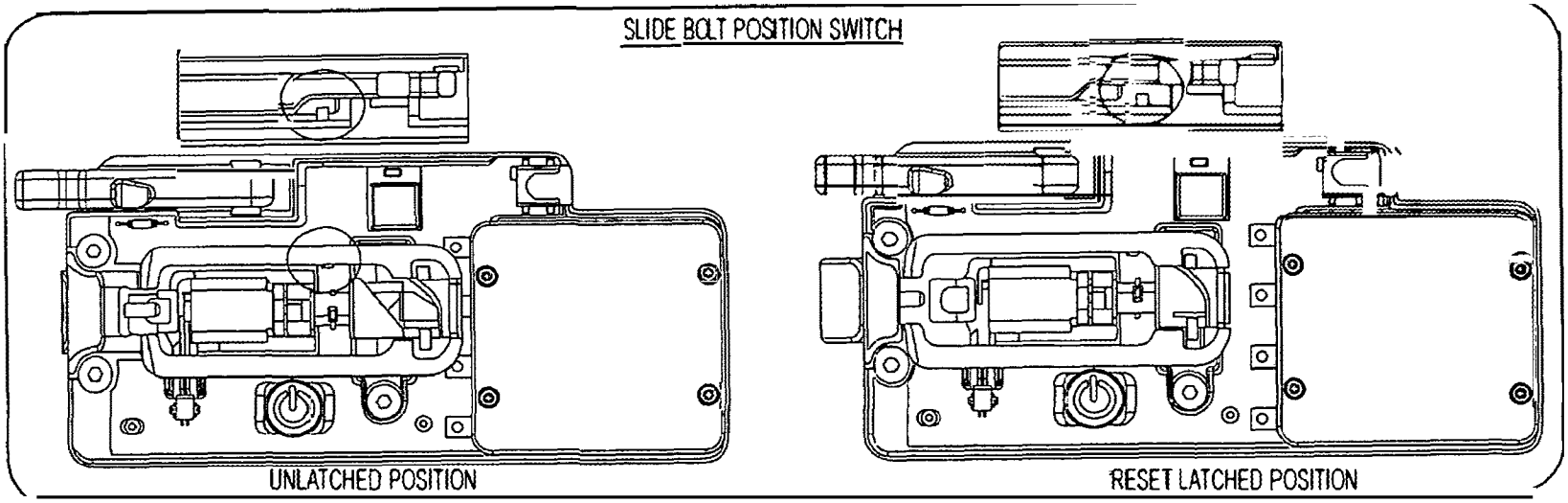
FIG. 18C
FIG. 18D LATCH SEQUENCE- CLOSE DOOR
| STATE | SIGNAL RECEIVED | DESCRIPTION | MOTOR ROTATION | MOTOR CONTROL SWITCH | SLIDE BOLT POSITION SWITCH | DOOR SWITCH (REED SWITCH) |
|---|---|---|---|---|---|---|
| 3 | NONE | OPERATOR SLAMS LATCH TO CLOSE | NONE | OFF | OFF TO ON TO OFF | OFF TO ON |
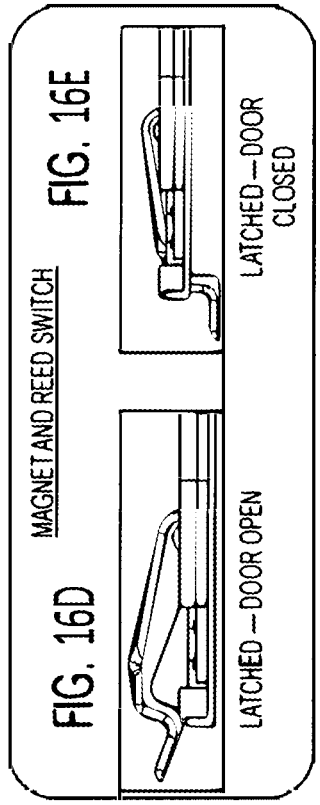
FIG. 16D
FIG. 16E
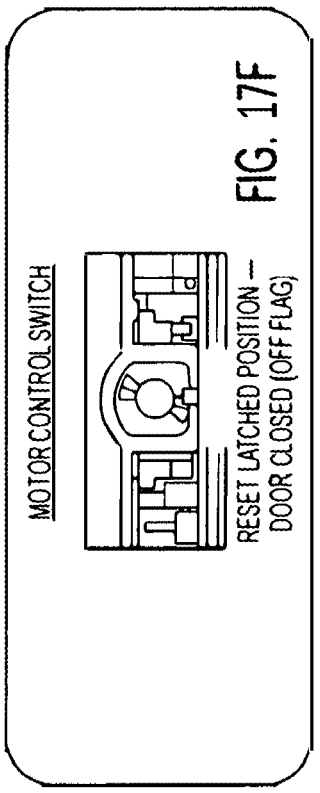
FIG. 17F
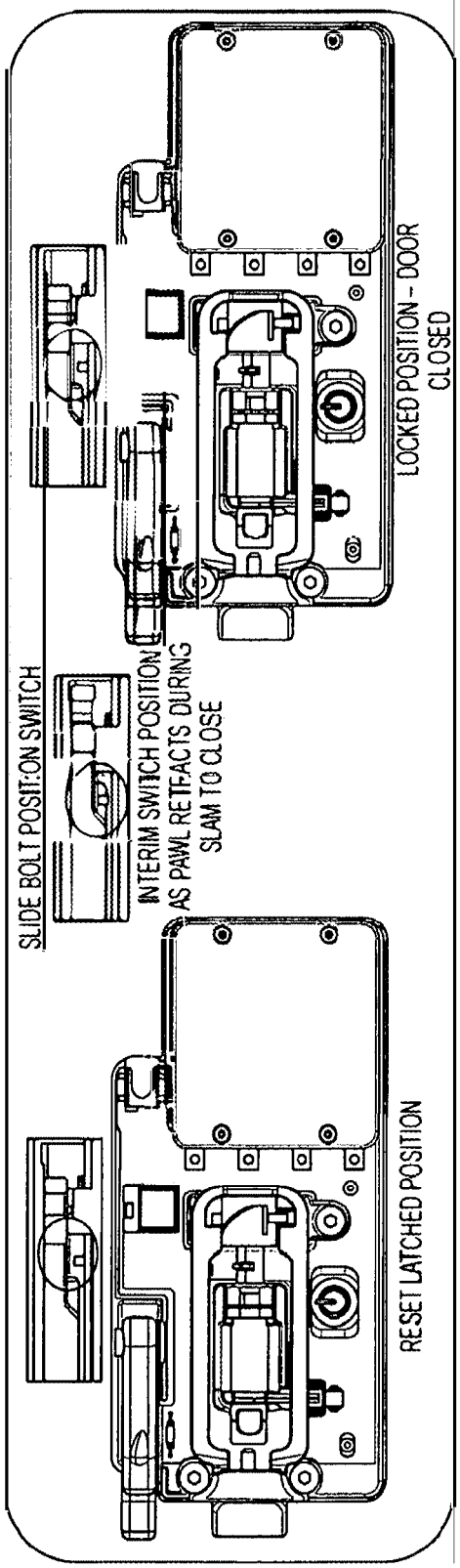
FIG. 18E
FIG. 18F

ELECTROMECHANICAL LOCKING LATCH

CROSS-REFERENCE TO RELATED APPLICATION

This application is a U.S. National Phase Application of PCT International Application PCT/US2017/017910, filed Feb. 15, 2017, and claims the benefit of priority of, U.S. Provisional Application No. 62/295,719, entitled ELECTROMECHANICAL LOCKING LATCH, filed on 16 Feb. 2016, the contents of which are incorporated herein by reference in their entirety for all purposes.

FIELD OF THE INVENTION

This disclosure relates to the field of latch assemblies.

BACKGROUND OF THE INVENTION

As is described in U.S. Pat. No. 8,496,275 to Garneau and U.S. Pat. No. 7,455,335 to Garneau, each of which is incorporated by reference herein in its entirety, latch assemblies are relied on in many applications for securing items, such as panels, doors, and doorframes together. For example, containers, cabinets, closets, drawers, compartments and the like may be secured with a latch. Furthermore, in many applications an electrically operated latch is desirable due to the need for remote or push-button entry, coded access, key-less access, or monitoring of access.

Various latches for panel closures have been employed where one of the panels such as a swinging door, drawer or the like is to be fastened or secured to a stationary panel, door frame, cabinet, or compartment body. There continues to be a need for improved latching systems in the interests of security to prevent unauthorized opening of latching systems.

SUMMARY OF THE INVENTION

Aspects of the invention relate to an electromechanical locking latch.

In accordance with one aspect, the invention provides an electronic latch assembly comprising a latch bolt that is movable between an extended position and a retracted position. A motor having a rotatable output shaft arrangement is either directly or indirectly connected to the latch bolt for moving the latch bolt between the extended and retracted positions and rotating the output shaft arrangement between a first angular position in which the latch bolt is capable of being translated to the retracted position and a second angular position in which the latch bolt is locked and not capable of being translated to the retracted position.

According to another aspect, the invention provides an electronic latch assembly comprising a housing including an interior compartment and a stopping surface defined within the interior compartment. A latch bolt is positioned at least partially within the interior compartment, and the latch bolt is movable between an extended position and a retracted position. A motor having a rotatable output shaft arrangement is either directly or indirectly connected to the latch bolt for moving the latch bolt between the extended and retracted positions. A protrusion extends from the output shaft arrangement. At a first angular position of the output shaft, the protrusion is maintained in an unlocked state in which the protrusion is separated from the stopping surface to permit movement of the latch bolt toward the retracted position. At a second angular position of the output shaft, the protrusion is maintained in a locked state in which the protrusion is positioned against the stopping surface to prevent movement of the latch bolt toward the retracted position.

According to yet another aspect, the invention provides an electronic latch assembly for selectively engaging a door opening. The electronic latch assembly comprises a housing including an interior compartment. A latch bolt is at least partially positioned within the interior compartment and movable between an extended position for engaging the door opening and a retracted position in which the latch bolt is disengaged from the door opening. A motor having a rotatable output shaft arrangement is either directly or indirectly connected to the latch bolt for moving the latch bolt between the extended and retracted positions. A spring-loaded lever is attached to the housing for biasing the electronic latch assembly away from the door opening when the latch bolt is maintained in the retracted position. A sensor for sensing a position of the lever communicates the sensed position of the lever to a controller of the electronic latch assembly.

BRIEF DESCRIPTION OF THE DRAWINGS

The invention is best understood from the following detailed description when read in connection with reference to the accompanying drawings. According to common practice, the various features of the drawings are not drawn to scale unless otherwise indicated. On the contrary, the dimensions of the various features may be expanded or reduced for clarity. Included in the drawings are the following figures:

FIGS. 16A-16F show the interaction between the lever and a reed switch; and FIGS. 17A-17G show the interaction between the output cam and a sensor.

FIGS. 18A-18H further illustrate components of the latch assembly of FIG. 10.

DETAILED DESCRIPTION OF THE INVENTION

Although the invention is illustrated and described herein with reference to specific embodiments, the invention is not intended to be limited to the details shown. Rather, various modifications may be made in the details within the scope and the range of equivalents of the claims without departing from the invention.

As used herein, "proximal" and "distal" refer to either a position or a direction relative to the latch bolt opening 9. For example, a proximal portion of a particular component is a portion nearer latch bolt opening 9, and a distal portion is a portion further from latch bolt opening 9. Furthermore, a proximal direction is a direction toward latch bolt opening 9 and a distal direction is a direction away from latch bolt opening 9.

Figure 1:
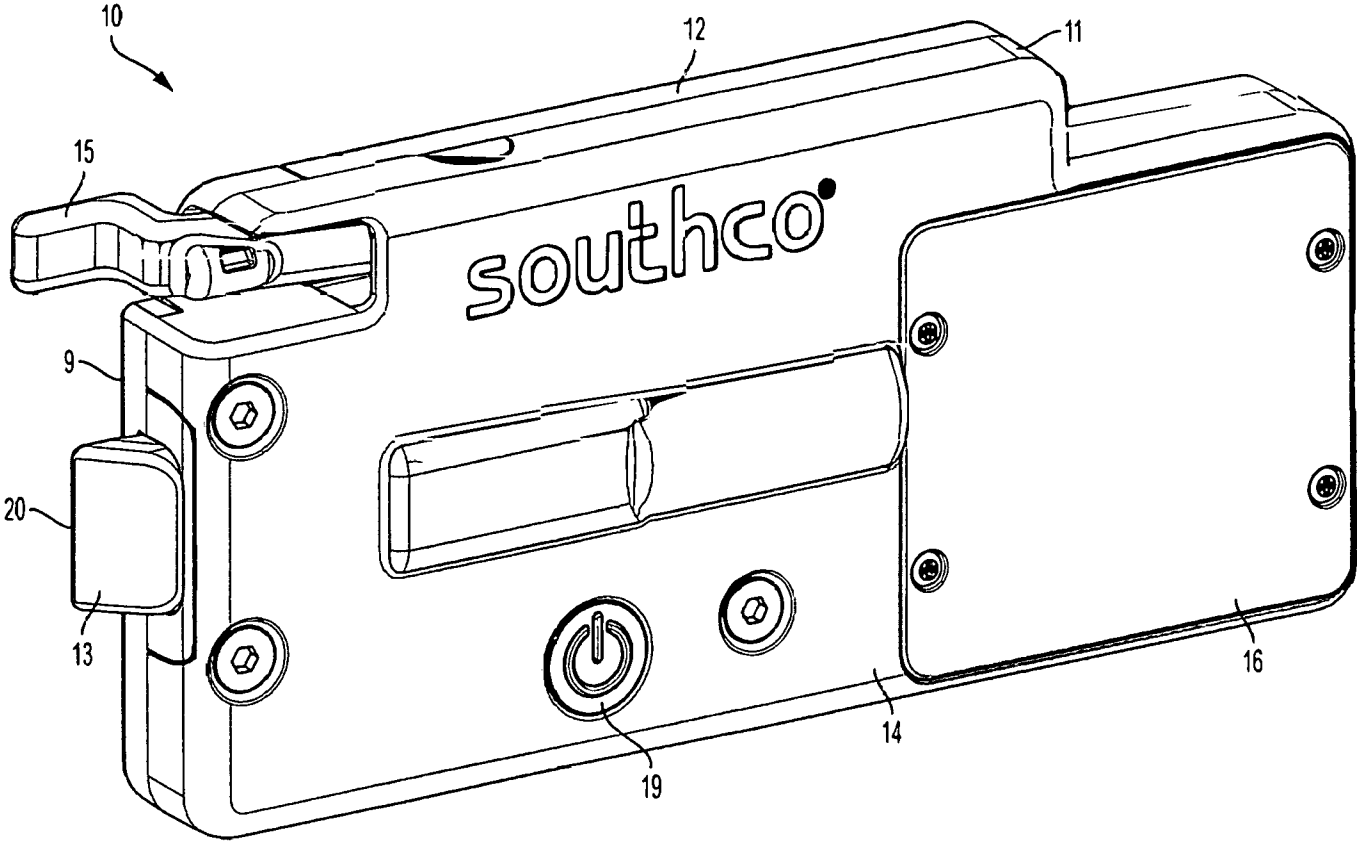
FIG. 1 is a perspective view of a latch assembly in accordance with aspects of the present invention.
Figure 2:
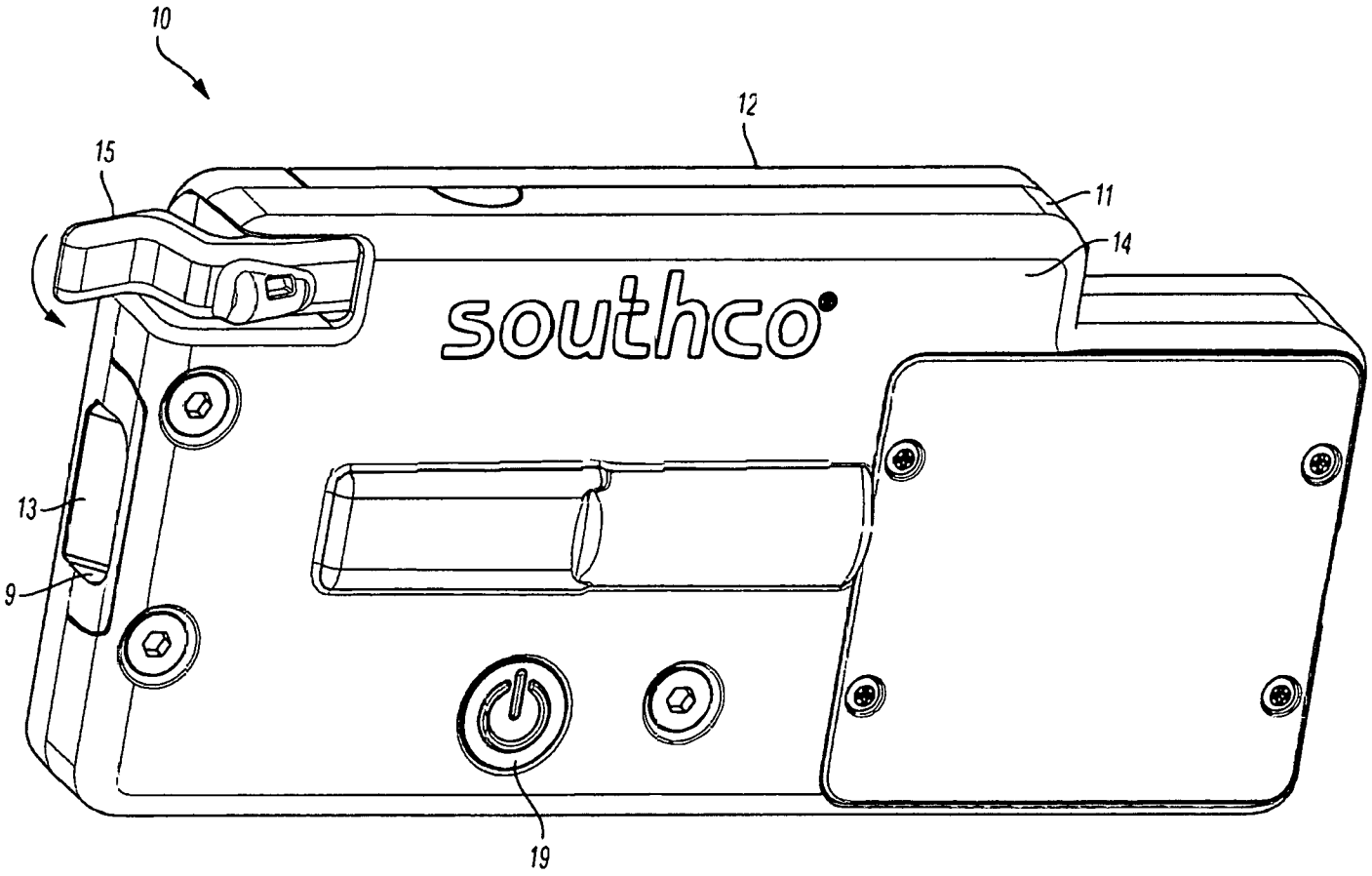
FIG. 2 is another perspective view of the latch assembly of FIG. 1 showing the lever and bolt portion in different states.
Figure 3:
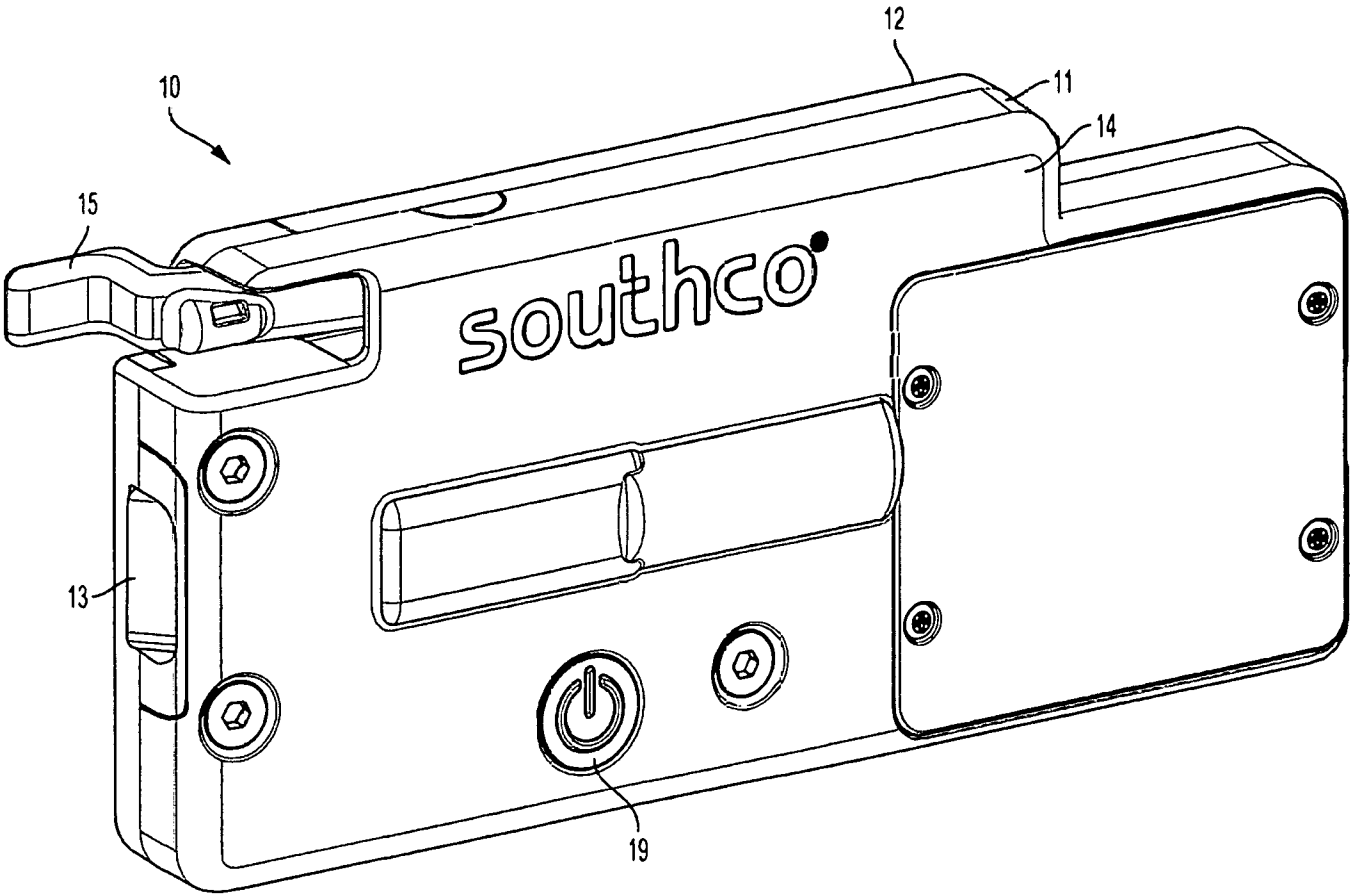
FIG. 3 is another perspective view of the latch assembly of FIG. 1 showing the bolt portion in a retracted state.

FIGS. 1-3 depict perspective views of a latch assembly 10, which is shown in an assembled form, according to one exemplary embodiment of the invention. The latch assembly 10 generally includes a housing enclosure 11 including a base portion 12, a lid portion 14 and a removable cover 16 for concealing a battery compartment in which one or more batteries 17 are installed. Alternatively, latch assembly 10 may be hardwired, and batteries 17 may be omitted. Base portion 12, lid portion 14 and removable cover 16 are mounted together by fasteners. Those components of housing enclosure 11 may be formed from metal or plastic, for example.

Latch assembly 10 can be fixed to a moveable door (not shown) for selectively mating with a stationary door opening (not shown), or vice versa, for example. For the purpose of simplicity, it should be assumed hereinafter that latch assembly 10 is permanently fixed to the moveable door, and latch assembly 10 selectively mates with an aperture of a stationary door opening.

Base portion 12 and lid portion 14 together form a hollow interior space in which internal components of the latch assembly 10 are positioned. Detailed views of base portion 12 are shown in FIGS. 6A-6G. Base portion 12 generally includes surfaces (such as 57 and 59) upon which many of the individual internal components of latch assembly 10 are mounted and/or seated. Base portion 12 may be a unitary component, or it may be composed of multiple components that are fixed together.

Three of the internal components positioned within the hollow interior space of housing enclosure 11 extend at least partially outside of housing enclosure 11, i.e., items 13, 15 and 19, as is shown in FIGS. 1-3.

More particularly, a bolt portion 20 of a spring-loaded latch bolt 13 extends through an opening 9 defined in the side of housing enclosure 11 for selectively engaging a stationary door opening (not shown), for example. Latch bolt 13 is moveable between the extended position shown in FIG. 1 and the retracted position shown in FIG. 2. In the extended position, bolt portion 20 can engage the door opening and in the retracted position, bolt portion 20 does not engage the door opening.

A spring-loaded lever 15 extends through a different opening defined in the same side of housing enclosure 11 for selectively engaging with the stationary door opening, for example. Lever 15 is configured to bias the door (not shown) away from the door opening (not shown). In operation, starting from a closed position of the door, to which latch assembly 10 is mounted, upon moving latch bolt 13 to the retracted position shown in FIG. 2, lever 15 moves from the compressed position shown in FIG. 1 to the expanded resting position shown in FIG. 2 thereby pushing the door (as well as the entire latch assembly 10) away from the door opening to automatically open the door without manual intervention by an end-user.

A control switch 19 is provided on the outer surface of housing enclosure 11 for manually operating latch assembly 10.

Figure 4:
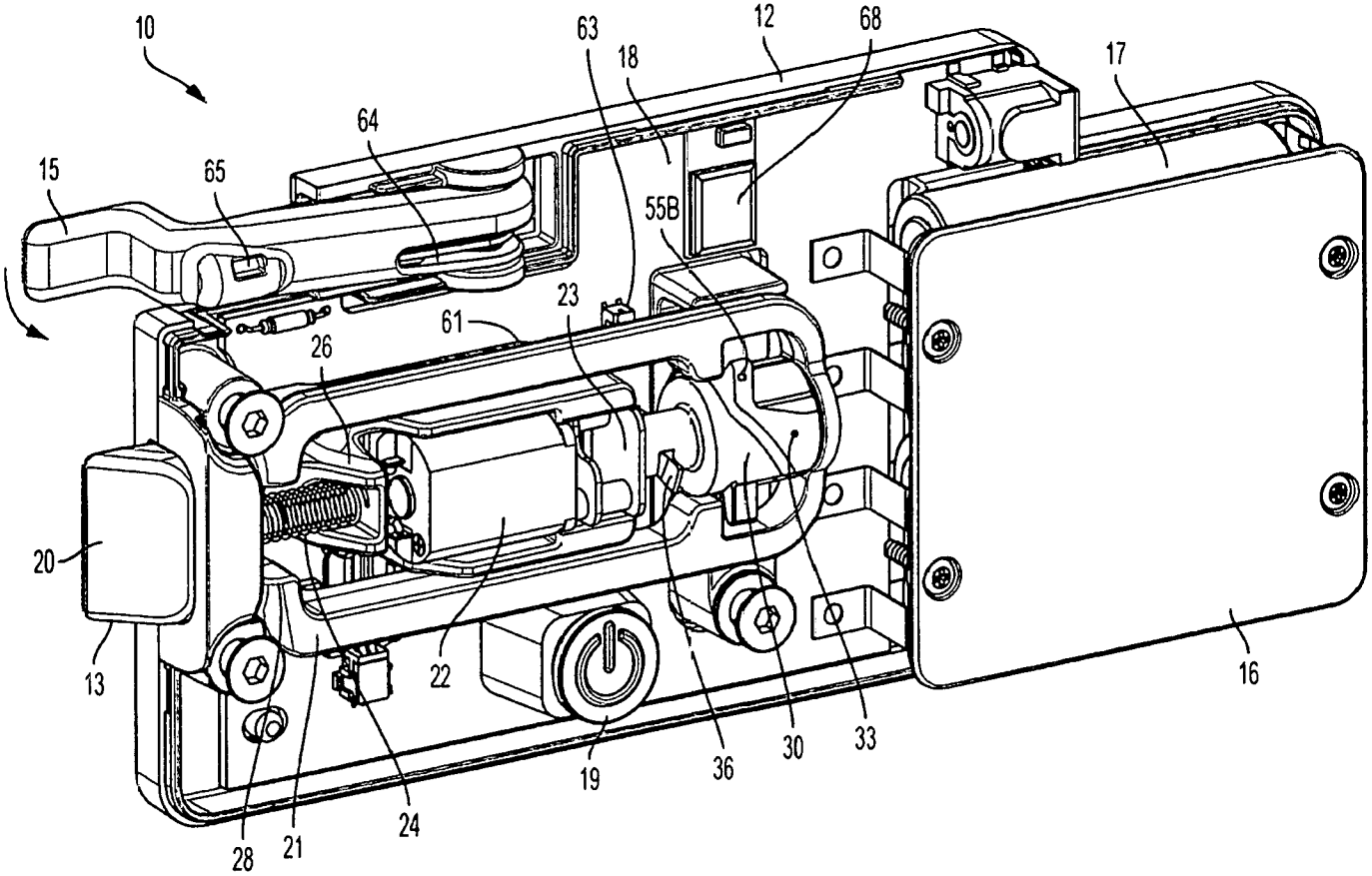
FIG. 4 is another perspective view of the latch assembly of FIG. 1 shown in an extended position with the lid portion removed to reveal the internal components of the latch assembly.
Figure 5:
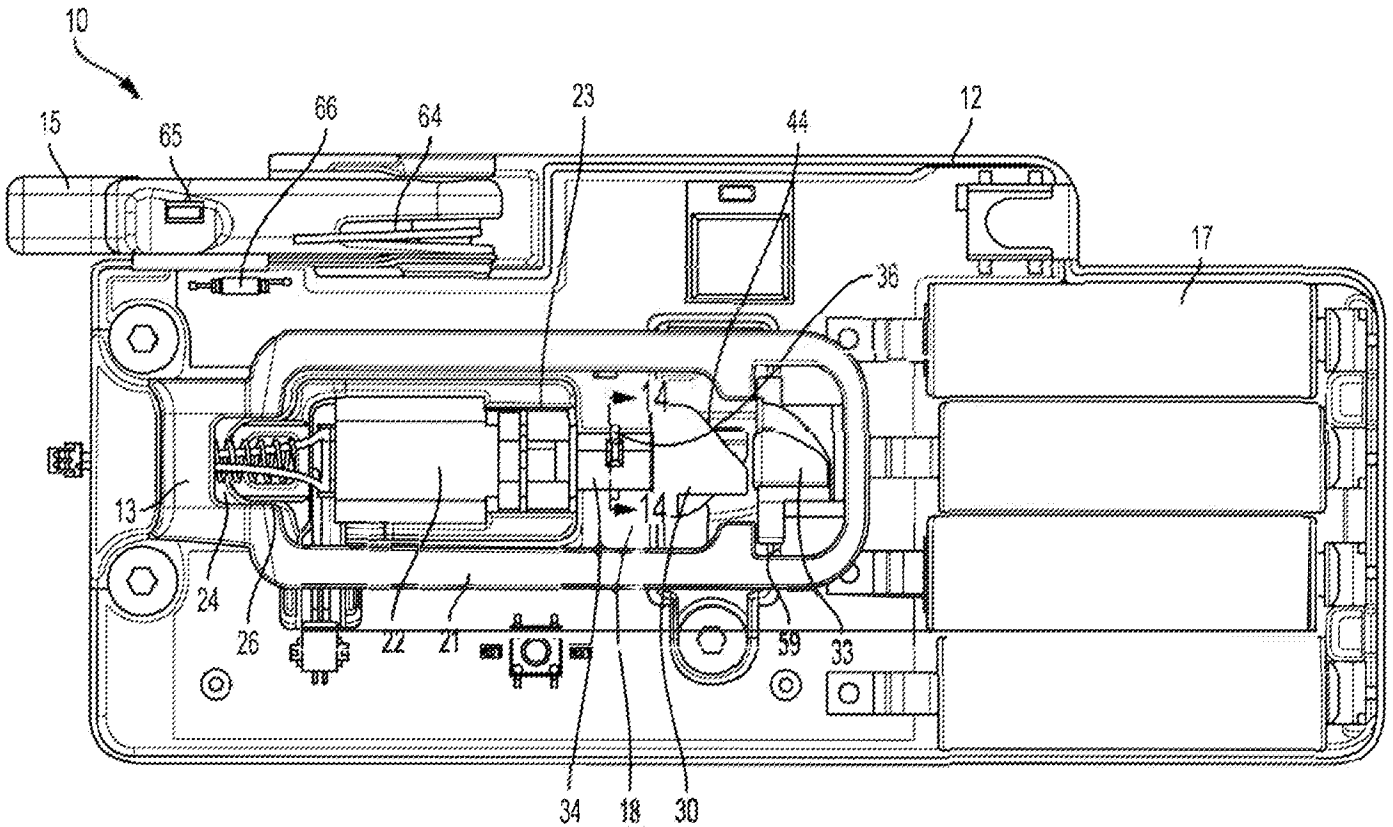
FIG. 5 is a top plan view of the latch assembly of FIG. 1 shown in a retracted position with the lid portion and the battery cover removed to reveal the internal components of the latch assembly.
Figure 6G:
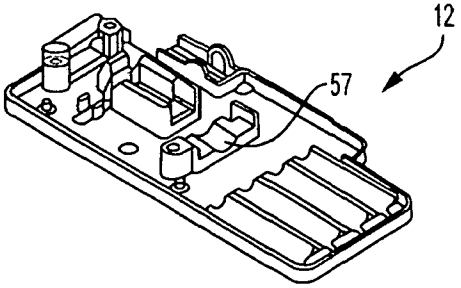
FIGS. 6A-6G are detailed views of the bottom portion of the housing of the latch assembly of FIG. 1.
Figure 6B:
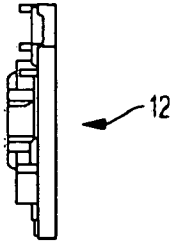
Figure 6D:
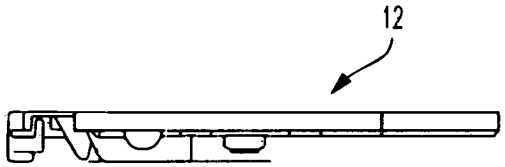
Figure 6A:
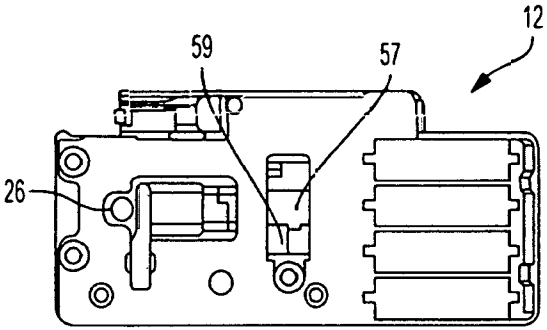
Figure 6E:
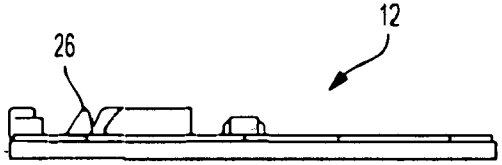
Figure 6C:
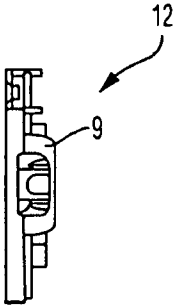
Figure 6F:
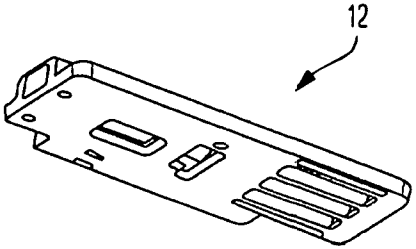

FIGS. 4 and 5 depict additional views of the latch assembly 10 shown partially disassembled to reveal the internal components of latch assembly 10. Lid 14 is omitted in FIG. 4, and lid 14 and cover 16 are omitted in FIG. 5. A printed circuit board (PCB) 18 is mounted to the inside wall of base portion 12. Most, if not all, of the electronic components of latch assembly 10 are mounted to PCB 18.

Referring now to the components associated with controlling the motion of spring-loaded latch bolt 13, the end of latch bolt 13 is moveably positioned through opening 9 in base portion 12. Latch bolt 13 translates in an axial direction between an extended position (see FIG. 4) and a retracted position (see FIG. 5). Latch bolt 13 includes a bolt portion 20 having a sloping surface for engaging with a conventional door opening, for example. A rectangular cage element 21, which is integrally formed with bolt portion 20, is positioned inside of housing enclosure 11. Cage element 21 surrounds several components of the electrically operated actuator assembly.

Figure 7F:
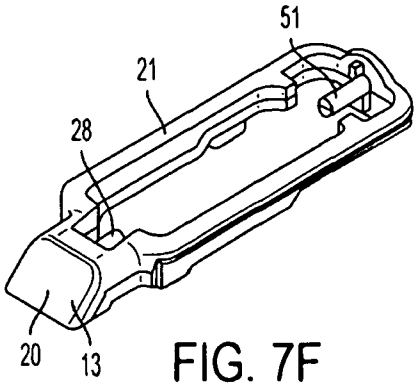
FIGS. 7A-7G are detailed views of the latch bolt of the latch assembly of FIG. 1.
Figure 7B:
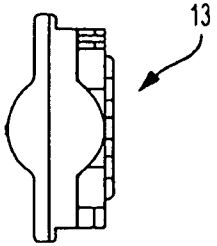
Figure 7G:
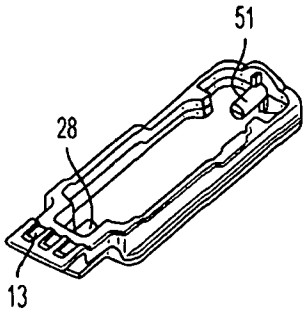
Figure 7D:
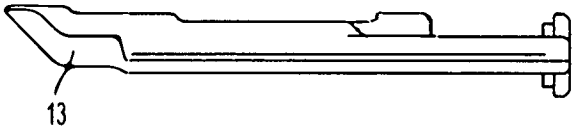
Figure 7A:
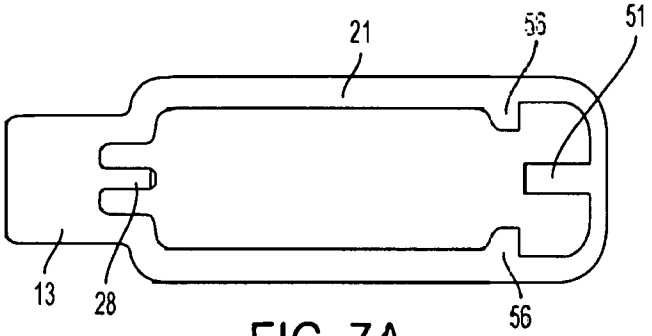
Figure 7E:
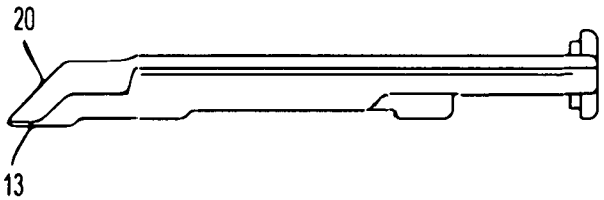
Figure 7C:
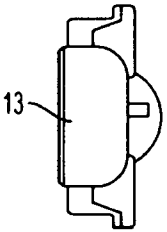
Figure 8F:
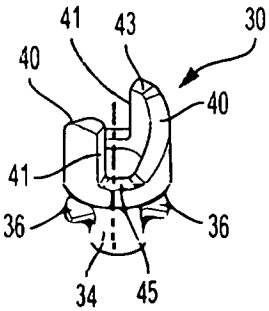
FIGS. 8A-8G are detailed views of the output cam of the latch assembly of FIG. 1.
Figure 8B:
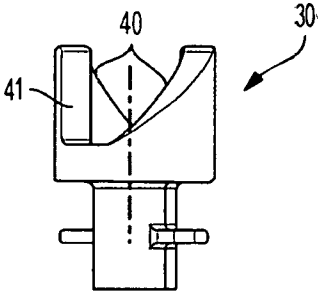
Figure 8G:
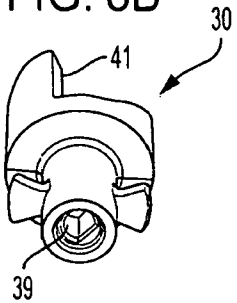
Figure 8D:
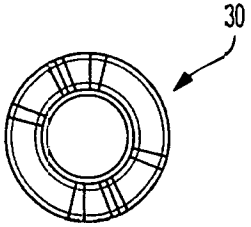
Figure 8A:
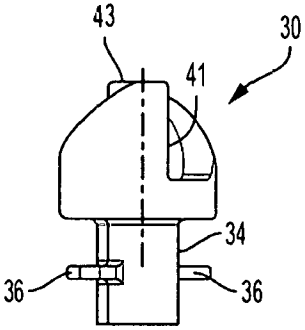
Figure 8E:
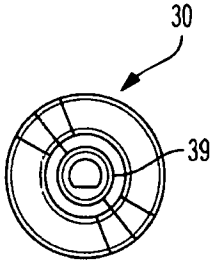
Figure 8C:
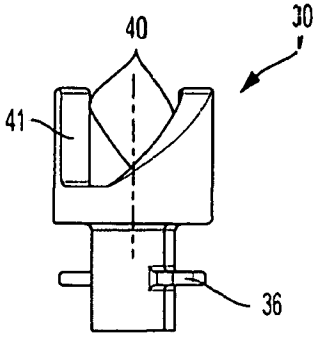
Figure 9G:
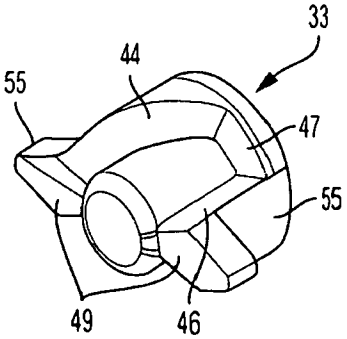
FIGS. 9A-9G are detailed views of the drive cam of the latch assembly of FIG. 1.
Figure 9B:
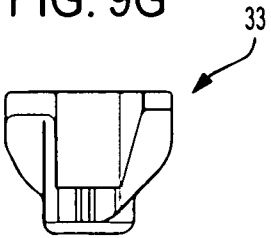
Figure 9D:
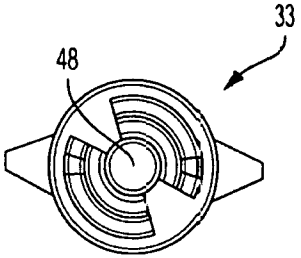
Figure 9A:
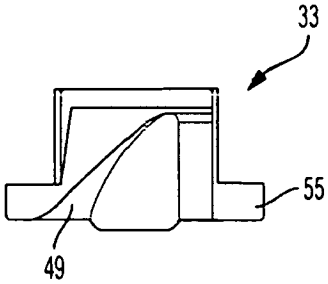
Figure 9E:
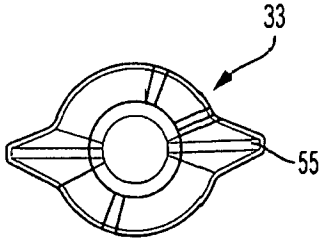
Figure 9C:
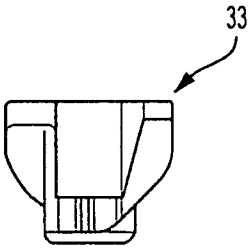
Figure 9F:
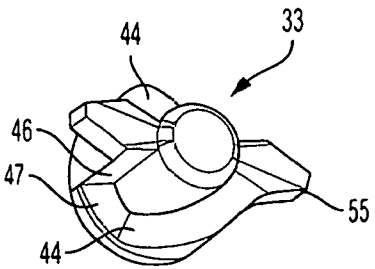

A compression spring 24 is mounted between a boss 26 extending from the interior surface of base portion 12 (see also FIGS. 6A and 6E) and a post 28 extending from the interior facing surface of latch bolt 13 (see also FIGS. 7A and 7G). Boss 26 is immovably fixed to base portion 12, whereas latch bolt 13 is capable of translating with respect to base portion 12. Accordingly, spring 24 is configured to bias latch bolt 13 toward the extended position shown in FIG. 4.

An electrically operated actuator assembly is configured to lock, unlock and move latch bolt 13 against the bias of spring 24. The electrically operated actuator assembly generally includes an electric motor 22, a reduction gear system 23, an output cam 30, and a drive cam 33. In the illustrated embodiment, the output shaft (not shown) of the motor 22 is engaged to the reduction gear system 23 such that it provides a motive force or an input torque to the reduction gear system 23 when the motor 22 is energized. The motive force or input torque provided by the motor 22 is rotational and imparts rotation to the gear wheels (not shown) of the reduction gear system 23. The operation of a reduction gear system and the interconnection between a reduction gear system and a motor output shaft are well known and therefore are not discussed in detail. Accordingly, the output shaft of the motor rotates in response to the motor being energized and in turn causes an output shaft (not shown) of the reduction gear system 23 to rotate. By a reduction gear system it is meant that the output shaft of the motor must rotate several times or more for each rotation of the output shaft of the reduction gear system 23. This arrangement increases the torque output of the motor, and, consequently, the size of the motor 22 required for the proper operation of the latch bolt 13 may be decreased. The reduction gear system 23 may be omitted if so desired.

Referring now to FIGS. 4, 5 and 8A-8G, the output shaft of reduction gear system 23 is connected to an output cam 30 having a cam surface at its distal end. Detailed views of output cam 30 are shown in FIGS. 8A-8G. Output cam 30 is a substantially cylindrical body of varying diameter that generally includes an axially extending central shaft portion 34 at its proximal end. Shaft portion 34 includes a receptacle 39 that is configured to receive the output shaft of reduction gear system 23 in such a manner that shaft portion 34 rotates with the reduction gear system 23 as a unit during normal operation of latch assembly 10. For example, receptacle 39 and the output shaft of reduction gear system 23 may have mating non-circular cross sections such that no relative rotation can occur between receptacle 39 and the output shaft of reduction gear system 23.

The output shaft of motor 22, reduction gear system 23, output cam 30 and drive cam 33 may be referred to herein as an output shaft arrangement.

Figures 14A, 14B, 15A, 15B:
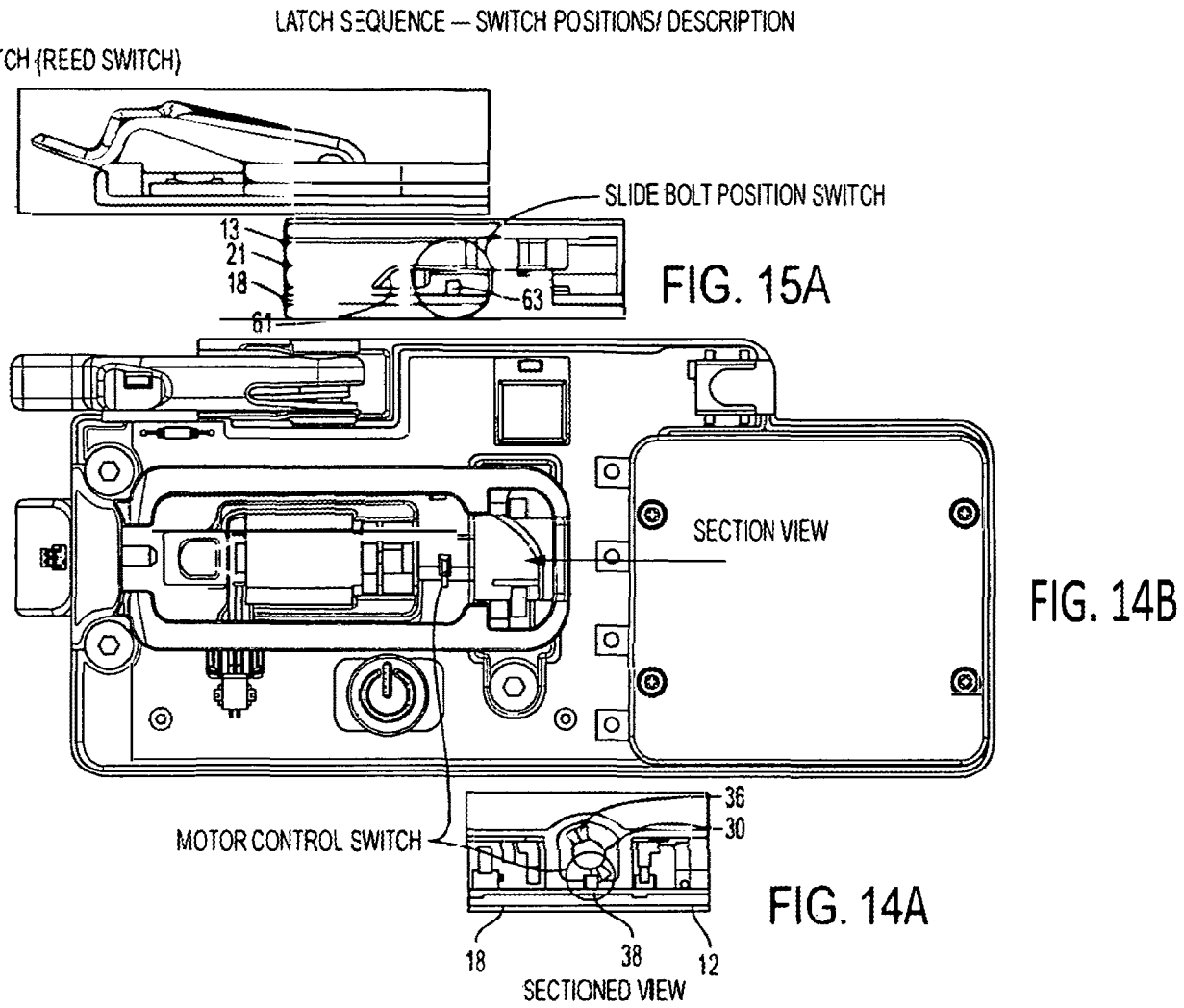
FIGS. 14A and 14B show a cross-sectional view of the latch assembly of FIG. 5 taken along the lines 14-14.
FIGS. 15A and 15B show a detailed view showing the interaction between the latch bolt and a sensor.

As shown in FIGS. 5 and 14, two protrusions 36A and 36B (referred to either individually or collectively as protrusion(s) 36), in the form of wings, extend outwardly in a radial direction from opposing sides of shaft portion 34. Protrusions 36 are evenly spaced apart along the circumference of shaft portion 34 by about 180 degrees. Each protrusion 36 has a radial width of about 45 degrees about the circumference of shaft portion 34. Protrusions 36 are configured to interface with a motor control sensor 38 on PCB 18, as shown in FIG. 14. Motor control sensor 38 senses the presence or absence of one of the protrusions 36. In other words, when a protrusion 36 is directly adjacent sensor 38, the sensor 38 registers the presence of protrusion 36; otherwise, it registers the absence of protrusion 36. Motor control sensor 38 may be an optical pass through sensor (as shown), an optical switch, a magnetic switch, or a mechanical switch, for example.

Output cam 30 includes sloping cam surfaces at its distal end. More particularly, a pair of ramps 40 at the distal end that each extend along a spiral path for about 150 degrees about the central axis of output cam 30. Each ramp 40 includes a cam surface arranged helically about the axis of rotation of output cam 30. A flat horizontal landing surface, which extends perpendicularly to the axis of rotation of output cam 30, is formed at the apex 43 of each ramp 40. Another flat horizontal landing surface, which extends perpendicularly to the axis of rotation of output cam 30, is formed at the base 45 of each ramp 40. A flat vertical surface 41, which extends parallel to the axis of rotation of output cam 30, connects apex 43 of one ramp 40 with base 45 of the other ramp 40. The angled surfaces of ramps 40 both rise in the same direction of rotation.

Referring now to FIGS. 4, 5 and 9A-9G, output cam 30 is configured to selectively engage a drive cam 33. Detailed views of drive cam 33 are shown in FIGS. 9A-9G. Drive cam 33 comprises a substantially circular body including a pair of ramps 44 at its proximal end that are substantially like ramps 40 of output cam 30. More particularly, each ramp 44 includes a cam surface arranged helically about the axis of rotation of drive cam 33. A flat horizontal landing surface, which extends perpendicularly to the axis of rotation of drive cam 33, is formed at the apex 49 of each ramp 44. Another flat horizontal landing surface, which extends perpendicularly to the axis of rotation of drive cam 33, is formed at the base 47 of each ramp 44. A flat vertical surface 46, which extends parallel to the axis of rotation of drive cam 33, connects the apex 49 of one ramp 44 with the base 47 of the other ramp 44. The angled surfaces of ramps 44 both rise in the same direction of rotation.

In the extended position of latch bolt 13 shown in FIG. 4, ramps 44 interlock with ramps 40 such that (i) the apex 43 of each ramp 40 seats against the base 47 of each ramp 44, (ii) apex 49 of each ramp 44 seats against the base 45 of each ramp 40, and (iii) the flat vertical surface 41 of each ramp 40 is positioned against flat vertical surface 46 of each ramp 44. In the retracted position of latch bolt 13 shown in FIG. 5, the apex 49 of each ramp 44 is positioned against the apex 43 of each ramp 40 and the sloping surfaces of the ramps 40 and 44 are disengaged from each other.

Drive cam 33 has a circular receptacle 48 (see FIG. 9D) that receives a circular post 51 extending from cage element 21 (see FIG. 7A). Drive cam 33 is capable of rotation to a limited extent about post 51. Drive cam 33 is also capable of translating in an axial direction to a limited extent along with cage element 21 of latch bolt 13. Drive cam 33 cannot translate with respect to cage element 21 because drive cam 33 is sandwiched between flanges 56 of cage element 21 and the distal inside surface of cage element 21. As best shown in FIGS. 13A-13C, the circular body of drive cam 33 is sandwiched in a radial direction between a semi-circular recess at 57 that is formed in base portion 12 and a complimentary semi-circular recess formed in lid portion 14. The sliding fit between drive cam 33, base portion 12 and lid portion 14 permits limited rotation and translation of drive cam 33 with respect to base portion 12 and lid portion 14, as is explained in greater detail with respect to FIGS. 10-12.

The drive cam 33 has two protrusions 55A and 55B (referred to either collectively or individually as protrusion(s) 55), in the form of wings, that extend outwardly in a radial direction from apexes 49 of drive cam 33. Protrusions 55 are spaced apart along the circumference of drive cam 33 by about 180 degrees. As noted above, drive cam 33 is capable of translating to a limited extent as well as rotating to a limited extent. Protrusions 55 are configured to limit both rotation and translation, as is described hereinafter, in order to selectively lock and unlock latch bolt 13.

FIGS. 13A-13C depict the interaction between drive cam 33 and housing enclosure 11. Drive cam 33 can rotate in either a clockwise direction or a counterclockwise direction until protrusions 55 bear on surfaces of base portion 12 and/or lid portion 14 thereby preventing further rotation of drive cam 33. Drive cam 33 can also translate in a distal direction along the sliding surface 57 (see also FIG. 6A) of base portion 12 and lid portion 14 until protrusion 55A bears on stopping surface 59 of base portion 12 and protrusion 55B bears on stopping surface 62 of lid portion 14. Once protrusions 55A and 55B bear on stopping surfaces 59 and 62, respectively, it is not possible to translate latch bolt 13 in a distal direction.

FIG. 15 is a detailed view showing the interaction between the latch bolt 13 and position sensor 63. Latch assembly 10 is configured to monitor the position of latch bolt 13 to determine whether or not latch bolt 13 is either extended or retracted. More particularly, cage element 21 of latch bolt 13 includes a protruding cage surface 61 that communicates with a position sensor 63 on PCB 18, as shown in FIG. 14. Position sensor 63 senses either the presence or absence of protruding cage surface 61. When latch bolt 13 is maintained in a retracted position, as shown in FIG. 5, position sensor 63 senses the presence of protruding cage surface 61. When latch bolt 1:3 is maintained in an extended position, as shown in FIG. 4, position sensor 63 does not sense the presence of protruding cage surface 61. Position sensor 63 may be an optical pass through sensor (as shown), an optical switch, a magnetic switch, or a mechanical switch, for example.

As explained above, latch assembly 10 includes a spring-loaded lever 15 that is configured to bias the door (not shown) and latch assembly 10 away from the door opening (not shown) with which the door engages. Lever 15 includes a torsion spring 64 that is configured to bias the lever 15 in the direction of the arrow shown in FIGS. 2 and 4. Starting from a closed position of the door, once latch bolt 13 is moved to the retracted position shown in FIG. 2, lever 15 moves from the compressed position shown in FIG. 1 to the expanded position shown in FIG. 2, by virtue of torsion spring 64, thereby pushing the door (as well as latch assembly 10) away from the door opening to automatically open the door without manual intervention by an end-user. It should be understood that lever 15 is manually operable.

Latch assembly 10 is configured to monitor the position of lever 15 to determine whether or not the door is open or closed. More particularly, lever 15 includes an embedded rare earth magnet 65 that communicates with a reed switch 66 on PCB 18, as shown in FIGS. 16A and 16B. In other words, reed switch 66 senses the magnetic field of magnet 65, as is well understood in the art. Reed switch 66 senses either the presence or absence of magnet 65. When lever 15 is maintained in the compressed position shown in FIG. 16A, i.e., when the door is closed, reed switch 66 senses the presence of magnet 65. When lever 15 is maintained in the expanded position shown in FIG. 16B, i.e., when the door is open, reed switch 66 does not sense the presence of magnet 65. Other devices for monitoring the position of lever 15 are envisioned. For example, reed switch 66 could be replaced with an optical pass through sensor, an optical switch, or a mechanical switch.

Latch assembly 10 includes a controller 68 mounted to PCB 18 that communicates with, at least, motor 22, reed switch 66, position sensor 63 and motor control sensor 38 to monitor and control operation of latch assembly 10.

PCB 18 also includes a receiver and transmitter that is connected to controller 68 to enable wireless communications to and from latch assembly 10. By way of example, controller 68 can transmit information relating to the locked, unlocked, latched and unlatched states of latch assembly 10, as well as the open and closed states of the door that is connected to latch assembly 10 based upon the various states of the sensors and switches 38, 63 and 66. Using this information, a user can determine whether the door is open or closed or the user can determine whether the latch assembly 10 is unlatched, locked or unlocked without having to visually inspect latch assembly 10 on site. Latch assembly 10 may also be remotely controlled using the receiver and transmitter. For example, a user may remotely instruct latch assembly 10 to open the door or unlock or lock the latch assembly 10. Communications to and from latch assembly 10 may be wireless, wired, web based, and/or cloud based, or any other conventional communication method known to those skilled in the art.

Described hereinafter is one exemplary method for operating latch assembly 10 according to FIGS. 10-12. It should be understood that the exemplary method is not limited to any particular step or sequence and may vary from that which is shown and described.

Figure 10:
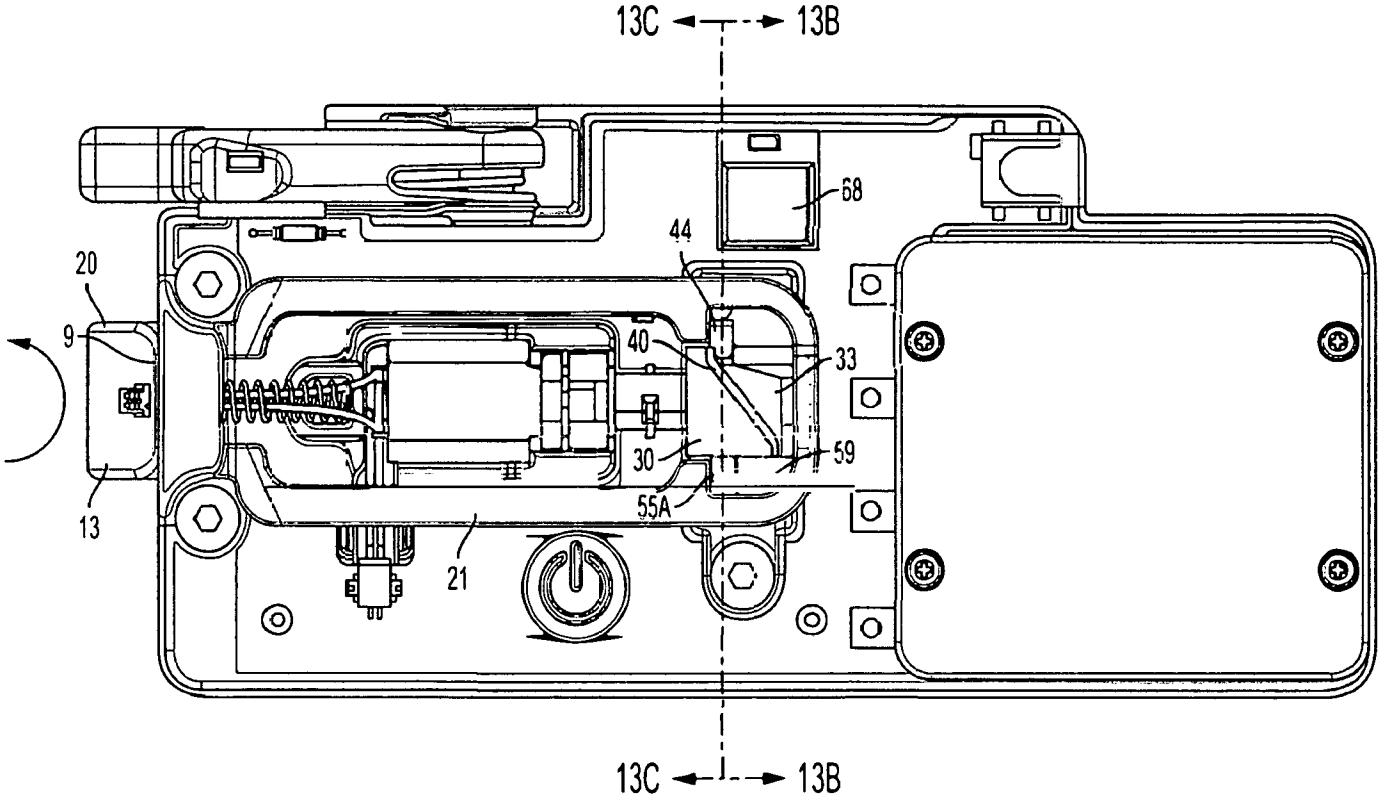
FIG. 10 is a top plan view of the latch assembly of FIG. 1 maintained in a locked configuration.
Figure 11:
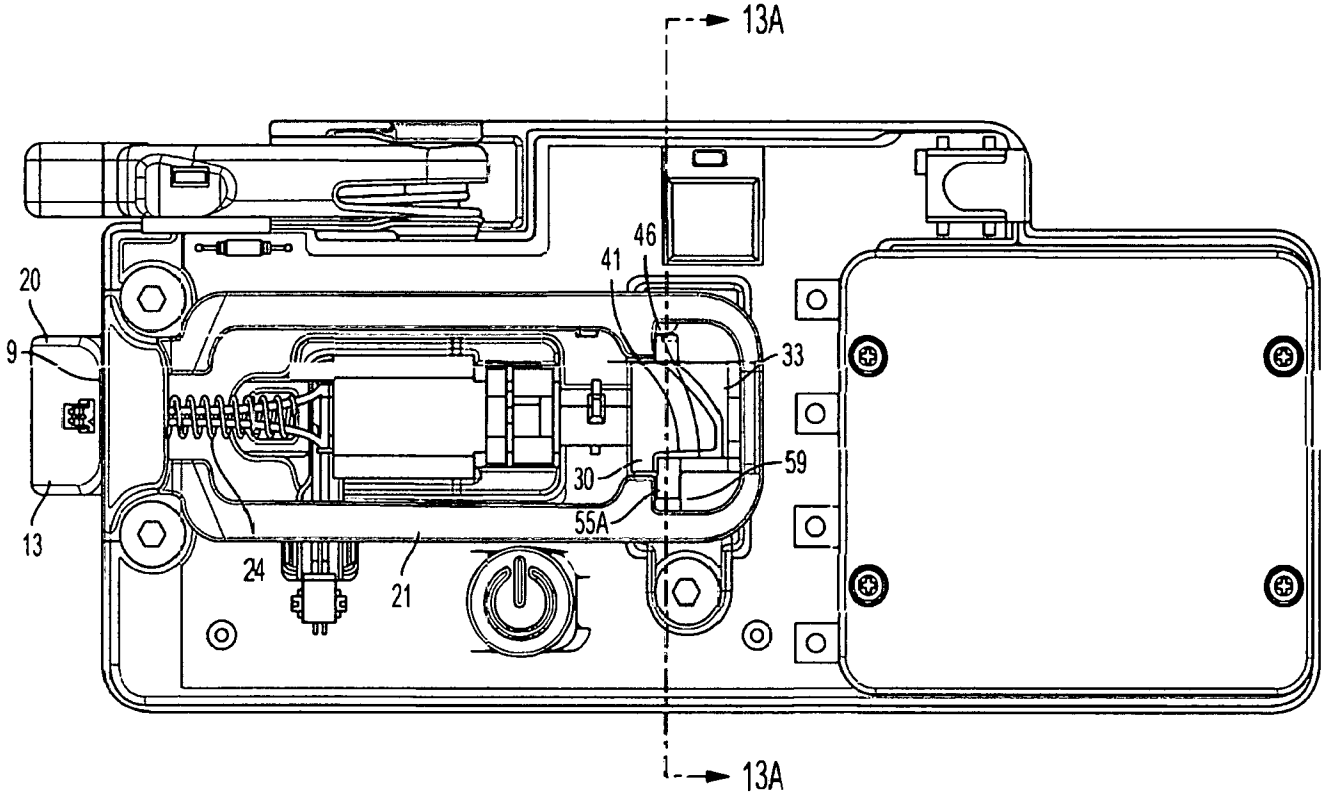
FIG. 11 is a top plan view of the latch assembly of FIG. 1 maintained in a latched configuration.
Figure 12:
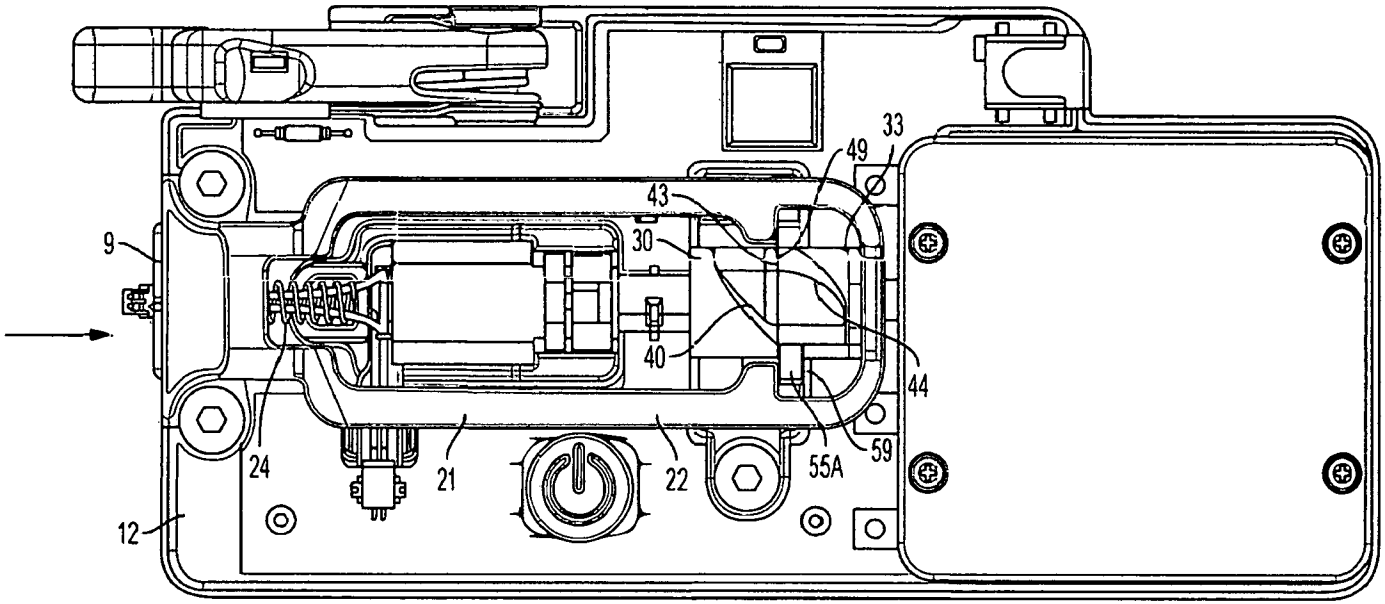
FIG. 12 is a top plan view of the latch assembly of FIG. 1 maintained in an unlatched configuration.
Figure 13A:
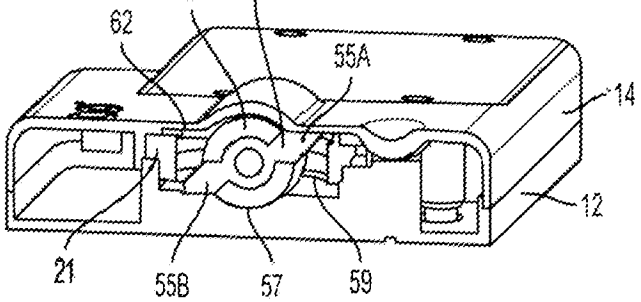
FIG. 13A is a cross-sectional view of the latch assembly of FIG. 11 taken along the lines 13A-13A.
Figure 13B:
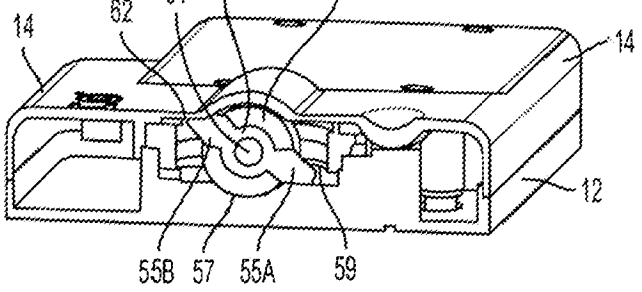
FIG. 13B is a cross-sectional view of the latch assembly of FIG. 10 taken along the lines 13B-13B.
Figure 13C:
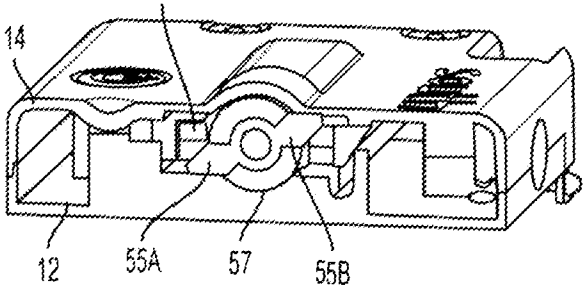
FIG. 13C is a cross-sectional view of the latch assembly of FIG. 10 taken along the lines 13C-13C.

FIGS. 10-12 taken together depict latch assembly 10 moving from the locked configuration shown in FIG. 10 to the unlocked configuration shown in FIG. 11 and to the unlatched configuration shown in FIG. 12. It is assumed for purposes of describing this operational method that latch assembly 10 starts in the locked configuration shown in FIG. 10, and that latch assembly 10 is affixed to a moveable door (not shown). It should be understood that latch assembly 10 could start in any particular configuration and that latch assembly 10 does not necessarily have to be affixed to a door.

Stage 1: Locked State of FIG. 10 to Unlocked State of FIG. 11

| State | Signal Received | Description | Motor Rotation | Motor control sensor (MCS) | Latch bolt position sensor (LBPS) | Reed Switch (door switch) (RS) |
|---|---|---|---|---|---|---|
| 1 | UNLOCK/UNLATCH | Motor rotates 45 degrees to unlock and immediately 135 degrees to unlatch. Latch | 45 + 135 degrees clockwise | OFF ON OFF ON | OFF to ON | ON to OFF |

-continued

| Stage 1: Locked State of FIG. 10 to Unlocked State of FIG. 11 | | | | | | |
|---|---|---|---|---|---|---|
| State | Signal Received | Description | Motor Rotation | Motor control sensor (MCS) | Latch bolt position sensor (LBPS) | Reed Switch (door switch) (RS) |
| | | Bolt retracts allowing door to kick open | | | | |

In the locked state shown in FIG. 10, latch bolt 13 of latch assembly 10 is both latched and locked in an aperture of a stationary door opening and lever 15 is biased against the door opening such that torsion spring 64 is maintained in a compressed configuration. In the locked state, it is not possible to open the door and it is also not possible to translate latch bolt 13 in distal direction (see arrow in FIG. 12) because protrusions 55A and 55B of output cam 33 bear on stopping surfaces 59 and 62, respectively, as described with reference to FIGS. 13A-13C.

In the locked state of latch assembly 10 shown in FIGS. 10, 16A, 17A and 18A, reed switch 66 is 'ON' because it senses the presence of lever 15, as shown in FIG. 16A. Motor control sensor 38 is 'OFF' because it does not sense protrusion 36A, as shown in FIG. 17A (the leading edge of protrusion 36A is slightly beyond the sensing area of sensor 38). Position sensor 63 is 'OFF' because it does not sense the presence of cage surface 61, which is in the position shown in FIG. 18A. Latch bolt 13, upon which cage surface 61 is defined, has also not yet moved. The sensors and switches communicate their particular 'ON' and 'OFF' states to controller 68 via PCB 18. Starting from the locked state of latch assembly 10 described above and depicted in FIG. 10, latch assembly 10 is operated to move to the unlocked configuration depicted in FIG. 11. More particularly, controller 68 transmits a signal to motor 22 to rotate output cam 30 in a clockwise direction (a clockwise arrow is shown in FIGS. 10 and 17A). As output cam 33 rotates, ramp surface 40 of output cam 30 engages ramp surface 44 of drive cam 33 causing drive cam 33 to simultaneously rotate in the clockwise direction.

Drive cam 33 cannot yet translate in an axial direction as output cam 30 is rotated due to the engagement between protrusions 55A and 55B of output cam 33 and stopping surfaces 59 and 62, respectively. Once drive cam 33 initially rotates by 45 degrees in the clockwise direction, however, protrusions 55A and 55B of output cam 33 radially separate from stopping surfaces 59 and 62, respectively. In other words, protrusions 55A and 55B of drive cam 33 move from the locked position shown in FIG. 13B to the unlocked position shown in FIG. 13A. As drive cam 33 initially rotates by 45 degrees in the clockwise direction, motor control sensor 38 is 'ON' because it senses protrusion 36A.

Upon reaching the unlocked position shown in FIG. 13A, drive cam 33 is prevented from further rotation in the clockwise direction because protrusions 55A and 55B bear on surfaces of the lid portion 14 and base portion 12. In the unlocked position of drive cam 33, latch bolt 13 is no longer in a locked configuration. Also, in the unlocked state of drive cam 33, it is possible to manually move latch bolt 13 and drive cam 33 in a distal direction.

After drive cam 33 has rotated by 45 degrees in the clockwise direction, reed switch 66 is still 'ON' because it senses the presence of lever 15. The lever 15 has not yet moved from the extended position shown in FIG. 16A. Motor control sensor 38 is 'OFF' because it no longer senses the presence of the trailing edge of protrusion 36A. Position sensor 63 is still 'OFF' because it does not sense the presence of cage surface 61, which is still in the position shown in FIG. 18A.

| Stage 2: Unlocked State of FIG. 11 to Unlatched State of FIG. 12 | | | | | | |
|---|---|---|---|---|---|---|
| State | Signal Received | Description | Motor Rotation | Motor control sensor (MCS) | Latch bolt position sensor (LBPS) | Reed Switch (door switch) (RS) |
| 1 | UNLOCK/UNLATCH | Motor rotates 45 degrees to unlock and immediately 135 degrees to unlatch. Latch Bolt retracts allowing door to kick open | 45 + 135 degrees clockwise | OFF ON OFF ON | OFF to ON | ON to OFF |

Motor 22 does not pause once latch bolt 13 is unlocked. Motor 22 continues to rotate output cam 30 in a clockwise direction until latch bolt 13 is unlatched. Controller 68 continues to transmit a signal to motor 22 to rotate output cam 30 in a clockwise direction by an additional 135 degrees (i.e., for a total of 180 degrees of clockwise rotation) causing latch assembly 10 to move from the unlocked state depicted in FIG. 11 to the unlatched state shown in FIG. 12.

More particularly, as output cam 30 is rotated in a clockwise direction by an additional 135 degrees, ramp surface 40 of output cam 30 rides along ramp surface 44 of drive cam 33 causing drive cam 33 (which is incapable of further rotation in the clockwise direction, as noted above) to translate in the distal direction until apex 49 of each ramp 44 bears on the apex 43 of each ramp 40 and the sloping surfaces of the ramps 40 and 44 are completely disengaged from each other, as shown in FIG. 12. As drive cam 33 translates in the distal direction, it pushes latch bolt 13 in the distal direction thereby withdrawing bolt portion 20 of latch bolt 13 from the opening 9.

Once bolt portion 20 of latch bolt 13 withdraws from opening 9, the spring-loaded lever 15 automatically springs forward under the force of spring 64 to move the door (to which latch assembly 10 is fixedly attached) away from the door opening. In other words, lever 15 moves from the position shown in FIG. 16A to the position shown in FIG. 16B. The door (not shown) is now open.

As output cam 30 is rotated in a clockwise direction by the additional 135 degrees, the motor control sensor 38 returns to the 'ON' state once the sensor 38 senses the leading edge of protrusion 36B, as shown in FIG. 17B. Once sensor 38 returns to the 'ON' state, controller 68 immediately deactivates motor 22. Motor 22 is not necessarily programmed to rotate through a predetermined angle of 180 degrees, rather, motor 22 is controlled based upon the signals transmitted to controller 68 by motor control sensor 38. Controller 68 tracks the sequence of ON and OFF states communicated by sensor 38.

Once latch assembly 10 is in the unlatched state, reed switch 66 is 'OFF' because it no longer senses the presence of magnet 65 embedded in lever 15, as shown in FIG. 16B. As noted above, motor control sensor 38 is 'ON' because it senses the leading edge of protrusion 36B, as shown in FIG. 17B. Position sensor 63 is also 'ON' because it senses the presence of cage surface 61, as shown in FIG. 18B.

Now that the door is open, latch bolt 13 must be returned to an unlocked and extended state shown in FIG. 11 so that latch bolt 13 can re-engage with the aperture in the door opening once the door is closed again. To accomplish this, after a predetermined time period (e.g., 2 seconds) has elapsed since reed switch 66 switches to the 'OFF' state (i.e., indicating that the latch assembly 10 is unlatched), controller 68 automatically transmits a signal to motor 22 to rotate output cam 30 in a clockwise direction by approximately 45 degrees causing latch assembly 10 to move from the unlatched state shown in FIG. 12 back to the unlocked state depicted in FIG. 11. Output cam 30 is rotated in the clockwise direction by approximately 45 degrees until sensor 38 no longer senses the trailing edge of protrusion 36B, as shown in FIG. 17C. At that moment, sensor 38 returns to the 'OFF' state and controller 68 immediately deactivates motor 22.

In the course of clockwise rotation of the output cam 30, apex 43 of cam 30 slides along apex 49 of cam 33 until the vertical surface 41 of cam 30 registers in a circumferential direction with vertical surface 46 of cam 33. It should be understood that, at this stage, drive cam 33 does not rotate. Once surfaces 41 and 46 of cams 30 and 33 register with one another, spring 24 causes latch bolt 13 and its cage 21 to translate drive cam 33 in a proximal direction until ramps 40 and 44 of cams 30 and 33 reengage with each other, respectively, as shown in FIG. 11. As latch bolt 13 translates in the proximal direction, the bolt portion 20 extends from opening 9 in base portion 12. Latch bolt 13 is now ready to be engaged with an aperture in a door opening.

Reed switch 66 remains 'OFF' because it does not sense the presence of magnet 65 embedded in lever 15, as shown in FIG. 16B (this assumes that the door has not yet been closed). Position sensor 63 returns to the 'OFF' state because it does not sense the presence of cage surface 61, which is now in the extended position shown in FIG. 18A.

As an alternative to the 2 second time delay described above, a user could be required to reset the latch assembly 10.

Stage 3: Unlatched State of FIG. 12 to Reset State

| State | Signal Received | Description | Motor Rotation | Motor control sensor (MCS) | Latch bolt position sensor (LBPS) | Reed Switch (door switch) (RS) |
|---|---|---|---|---|---|---|
| 2 | NONE | Latch Bolt extends under spring force (timed) | 45 degrees clockwise | ON OFF ON | ON to OFF | OFF |
| | PAWL EXTEND | Latch Bolt extends under spring force (Signal) | | | | |

| Stage 4: Reset State to Unlocked State of FIG. 11 | | | | | | |
|---|---|---|---|---|---|---|
| State | Signal Received | Description | Motor Rotation | Motor control sensor (MCS) | Latch bolt position sensor (LBPS) | Reed Switch (door switch) (RS) |
| 3 | NONE | Operator slams latch to close | None | ON | OFF to ON to OFF | OFF to ON |

The end-user then manually closes the door to which the latch assembly 10 is attached. As bolt portion 20 slides along the door opening, the latch bolt 13 and drive cam 33 initially translate in the distal direction against the force of spring 24. At that moment, position sensor 63 briefly returns to the 'ON' state because it senses the presence of cage surface 61, which is now in the retracted position shown in FIG. 186. Shortly thereafter, once bolt portion 20 fully registers with the aperture in the door opening, the bolt portion 20 springs into the aperture by virtue of the force of spring 24, and latch bolt 13 and drive cam 33 translate in the proximal direction and into the latched position shown in FIG. 11. At that moment, position sensor 63 returns to the 'OFF' state because it no longer senses the presence of cage surface 61, which is now in the extended position shown in FIG. 18A.

Figures 16F, 17D, 17G, 18G, 18H:
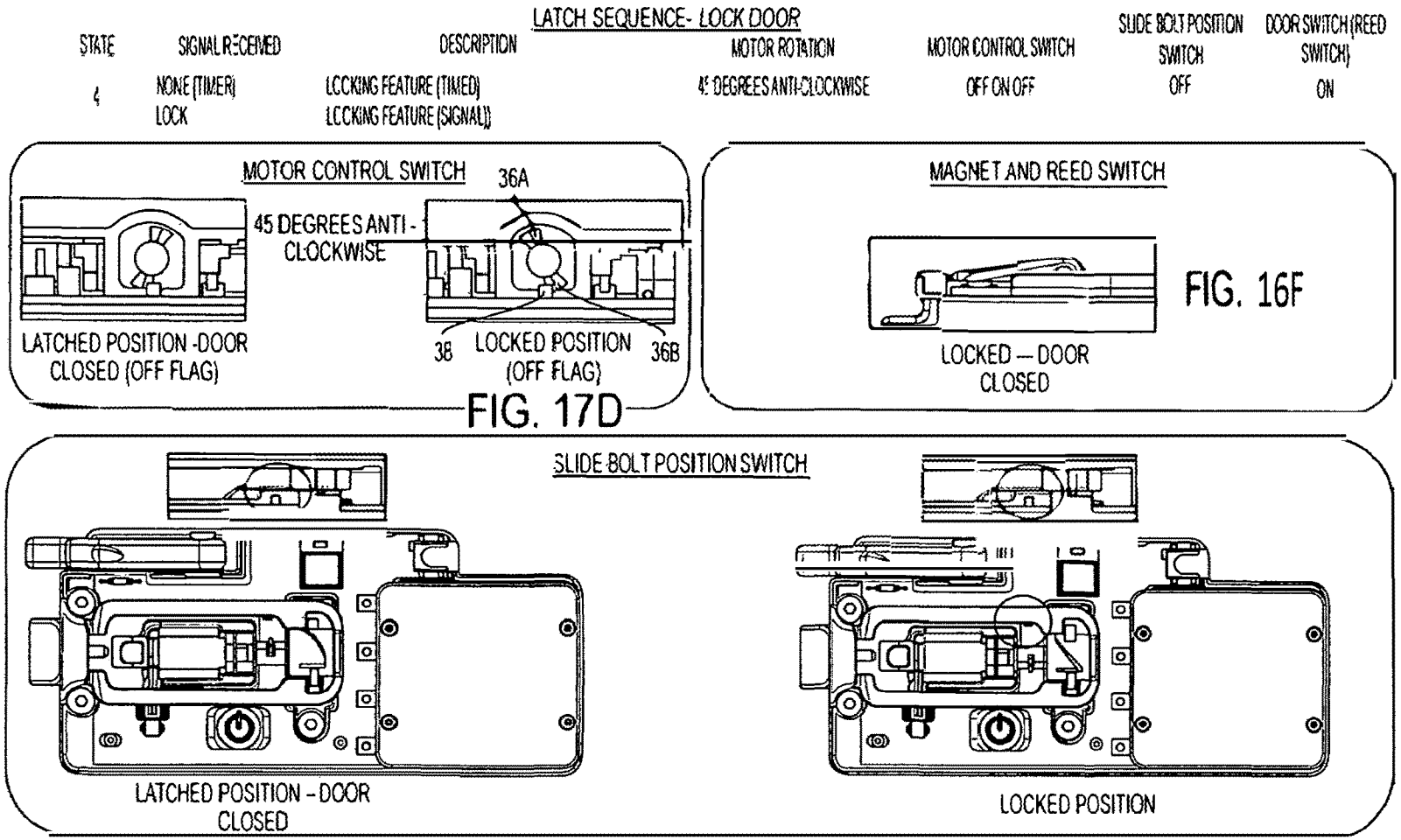

As the end-user closes the door, the lever 15 comes into contact with the door opening and the end-user pushes the door closed against the spring force of lever 15. Once the door is closed, lever 15 returns to the extended state shown in FIG. 16A and reed switch 66 returns to the 'ON' state because it senses the presence of the magnet within lever 15. It should be understood that neither cam 30 nor cam 33 rotate during this stage.

protrusion 366 as the protrusion 36B moves from the position shown in FIG. 17C to the position shown in FIG. 17D. At that moment, sensor 38 returns to the 'OFF' state and controller 68 immediately deactivates motor 22.

As an alternative to the above-described time delay, a user could instruct latch assembly 10 to lock.

Counterclockwise rotation of the drive cam 33 causes the protrusions 55A and 55B of output cam 33 to bear on stopping surfaces 59 and 62, respectively, as shown in FIG. 13B, thereby preventing translation of latch bolt 13 and drive cam 33 in the distal direction. The latch bolt 13 is thereby maintained in the locked configuration shown in FIG. 10.

In the locked configuration shown in FIG. 10, latch bolt 13 of latch assembly 10 is both latched and locked in an aperture of a stationary door opening, and lever 15 is biased against the door opening such that torsion spring 64 is maintained in a compressed configuration. In the locked configuration, it is not possible to open the door and it is also not possible to translate latch bolt 13 in distal direction (see arrow in FIG. 12) because protrusions 55A and 55B of output cam 33 bear on stopping surfaces 59 and 62, respectively, as described with reference to FIGS. 13A-13C.

| Stage 5: Unlocked State of FIG. 11 to Locked State of FIG. 10 | | | | | | |
|---|---|---|---|---|---|---|
| State | Signal Received | Description | Motor Rotation | Motor control sensor (MCS) | Latch bolt position sensor (LBPS) | Reed Switch (door switch) (RS) |
| 4 | NONE (timer) | Locking feature (timed) | 45 degrees anti-clockwise | ON OFF ON | OFF | ON |
| | LOCK | Locking feature (signal) | | | | |

Now that the door is latched closed, there exists the potential that an unauthorized user could tamper with latch assembly 10 by manually moving the bolt portion 20 to the unlatched state shown in FIG. 12, thereby causing the door to open. For that reason, latch assembly 10 is automatically caused to move to the locked state shown in FIGS. 10 and 13B.

Starting from the closed state shown in FIG. 11, after a predetermined time period (e.g., 2 seconds) has elapsed since reed switch 66 returned to the 'ON' state, as described above in Stage 4, controller 68 automatically transmits a signal to motor 22 to rotate output cam 30 in a counterclockwise direction causing latch assembly 10 to move from the unlocked state depicted in FIG. 11 to the locked state depicted in FIG. 10. As output cam 30 is rotated in the counterclockwise direction, the vertical surface 41 of cam 30 rotates the vertical surface 46 of drive cam 33 in the counterclockwise direction by approximately 45 degrees until the sensor 38 no longer senses the trailing edge of In the locked configuration of latch assembly 10 shown in FIG. 10, reed switch 66 is 'ON' because it senses the presence of lever 15. Motor control sensor 38 is 'OFF' because it does not sense any protrusions 36, as shown in FIG. 17D. Position sensor 63 is 'OFF' because it does not sense the presence of cage surface 61, which is in the position shown in FIG. 18A.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. An electronic latch assembly comprising:

a latch bolt movable between an extended position and a retracted position; and a motor having a rotatable output shaft arrangement that is either directly or indirectly connected to the latch bolt for moving the latch bolt between the extended and retracted positions, the output shaft arrangement comprising an output cam and a drive cam in contact with one another, and wherein rotating the output cam of the output shaft arrangement a first amount causes rotation of the drive cam between a first angular position in which the latch bolt is locked in the extended position and not capable of being translated to the retracted position and a second angular position in which the latch bolt is not locked in the extended position and is capable of being translated to the retracted position, and rotating the output cam a second further amount causes axial translation of the drive cam.

2. The electronic latch assembly of claim 1, further comprising:

a housing including an interior compartment, wherein the latch bolt is at least partially positioned within the interior compartment;

a spring-loaded lever attached to the housing for biasing the electronic latch assembly away from an opening when the latch bolt is maintained in the retracted position; and a sensor for sensing a position of the lever and communicating the sensed position of the lever to a controller of the electronic latch assembly.

3. An electronic latch assembly comprising:

a housing including an interior compartment and a stopping surface defined within the interior compartment;

a latch bolt positioned at least partially within the interior compartment, the latch bolt movable between an extended position and a retracted position;

a motor having a rotatable output shaft arrangement that is either directly or indirectly connected to the latch bolt for moving the latch bolt between the extended and retracted positions the output shaft arrangement comprising an output cam and a drive cam in contact with one another; and a protrusion extending from the output shaft arrangement, wherein at a first angular position of the output cam of the output shaft arrangement, the drive cam is rotated such that the protrusion is maintained in a locked state in which the latch bolt is in the extended position and the protrusion is positioned against the stopping surface to prevent movement of the latch bolt toward the retracted position, and, at a second angular position of the output cam of the output shaft arrangement, the drive cam is rotated such that the protrusion is maintained in an unlocked state in which the latch bolt is in the extended position and the protrusion is separated from the stopping surface to permit movement of the latch bolt toward the retracted position, and wherein, at a third angular position of the output cam of the output shaft arrangement, the drive cam is axially translated such that the latch bolt is in the retracted position.

4. The electronic latch assembly of claim 3, wherein the motor is configured to be operated to rotate the output shaft arrangement in a first rotational direction to position the protrusion in the locked state, and the motor is configured to be operated to rotate the output shaft arrangement in a second rotational direction, which is opposite the first rotational direction, to position the protrusion in the unlocked state.

* * * * *